US008784184B2

(12) United States Patent
Bennett et al.

(10) Patent No.: US 8,784,184 B2
(45) **Date of Patent: *Jul. 22, 2014**

(54) GAMING MACHINE WITH WIN CHANGE SYMBOL

(71) Applicant: Aristocrat Technologies Australia Pty Limited, North Ryde (AU)

(72) Inventors: Nicholas Luke Bennett, Manly Vale (AU); Natalie Bryant, Cherrybrook (AU)

(73) Assignee: Aristocrat Technologies Australia Pty Ltd. (AU)

( * ) Notice: Subject to any disclaimer, the term of this patent is extended or adjusted under 35 U.S.C. 154(b) by 0 days.

This patent is subject to a terminal disclaimer.

(21) Appl. No.: 13/724,406

(22) Filed: Dec. 21, 2012

(65) Prior Publication Data

US 2013/0190070 A1 Jul. 25, 2013

Related U.S. Application Data

(63) Continuation of application No. 12/839,738, filed on Jul. 20, 2012, now Pat. No. 8,360,849, which is a continuation of application No. 10/296,077, filed as application No. PCT/AU01/00550 on May 14, 2001, now Pat. No. 7,837,546.

(30) Foreign Application Priority Data

May 22, 2000 (AU) ..... PQ7664

(51) Int. Cl.
*G07F 17/32* (2006.01)

(52) U.S. Cl.
USPC ..... 463/20; 463/21

(58) Field of Classification Search
USPC ..... 463/20, 21
See application file for complete search history.

(56) References Cited

U.S. PATENT DOCUMENTS

| | | | | |
|---|---|---|---|---|
| 3,834,712 | A * | 9/1974 | Cox | 273/143 R |
| 6,386,973 | B1 | 5/2002 | Yoseloff | |
| 6,517,432 | B1 | 2/2003 | Jaffe | |
| 6,554,704 | B2 | 4/2003 | Nicastro et al. | |

(Continued)

FOREIGN PATENT DOCUMENTS

| | | |
|---|---|---|
| AU | 46824/97 | 6/1998 |
| AU | 17318/99 | 9/1999 |

(Continued)

OTHER PUBLICATIONS

International Search Report mailed Jun. 14, 2001 corresponding to International Application No. PCT/AU01/00550.

*Primary Examiner* — Pierre E Elisca
(74) *Attorney, Agent, or Firm* — McAndrews, Held & Malloy, Ltd.

(57) ABSTRACT

A gaming machine (10) has a display (14) and a game controller arranged to control images displayed on the display (14). The game controller is arranged to play a game (16) wherein at least one random event is caused to be displayed on the display (14). If a predefined winning event occurs, the machine (10) awards a prize. When a special symbol is carried by a symbol-carrying element into a display position on the display (14), the special symbol does at least one of altering the prize awarded for a winning result and altering a defined set of winning combinations.

4 Claims, 9 Drawing Sheets

(56) References Cited

U.S. PATENT DOCUMENTS

| | | | | |
|---|---|---|---|---|
| 6,663,487 | B1 | 12/2003 | Ladner | |
| 8,360,849 | B2 * | 1/2013 | Bennett et al. | 463/20 |
| 2008/0081688 | A1 * | 4/2008 | Plowman | 463/20 |
| 2008/0113739 | A1 * | 5/2008 | Visser et al. | 463/20 |
| 2008/0300037 | A1 | 12/2008 | Wilson | |
| 2009/0054134 | A1 | 2/2009 | Jackson | |
| 2009/0176554 | A1 | 7/2009 | Vallejo et al. | |
| 2010/0124971 | A1 | 5/2010 | Baerlocher et al. | |
| 2010/0210336 | A1 | 8/2010 | Berman et al. | |
| 2011/0021266 | A1 | 1/2011 | Jaffe et al. | |
| 2011/0218026 | A1 | 9/2011 | Grimm et al. | |
| 2011/0244942 | A1 | 10/2011 | Aoki | |
| 2012/0122545 | A1 | 5/2012 | Watkins et al. | |
| 2012/0157184 | A1 * | 6/2012 | Plowman | 463/20 |

FOREIGN PATENT DOCUMENTS

| | | |
|---|---|---|
| EP | 238289 | 9/1987 |
| EP | 420586 | 4/1991 |
| EP | 926645 | 6/1999 |

* cited by examiner

| | | | | |
|---|---|---|---|---|
| 9 | J | 9 | 10 | Q |
| J | 9 | J | J | K |
| Q | Q | Q | Q | J |

GAMING MACHINE WITH WIN CHANGE SYMBOL

RELATED APPLICATIONS

This application is a continuation of U.S. application Ser. No. 12/839,738 having a filing date of Jul. 20, 2010 which claims priority to, and is a continuation of co-pending U.S. application Ser. No. 10/296,077 having a filing date of Nov. 19, 2002, which claims priority to PCT Patent Application No. PCT/AU01/00550, filed May 14, 2001, and which claims priority to Australian Patent Application No. PQ7664, filed May 22, 2000, all of which are incorporated herein by reference in their entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

This invention relates to a gaming machine. More particularly, the invention relates to a gaming machine and to an improvement to a game played on such a gaming machine.

Players who regularly play gaming machines quickly tire of particular games and therefore it is necessary for manufacturers of these machines to develop innovative game features which add interest to the games. In so doing, it is hoped to keep players amused and therefore willing to continue playing the game as well as to attract new players.

Also, with the growth that has occurred in the gaming machine market, there is intense competition between manufacturers to supply various existing and new venues. When selecting a supplier of gaming machines, the operator of a venue will often pay close attention to the popularity of various games with their patrons. Therefore, gaming machine manufacturers are keen to devise games which are popular with the players as a mechanism for improving sales, retaining customers and attracting new customers.

BRIEF SUMMARY OF THE INVENTION

According to a first aspect of the invention, there is provided a gaming machine having a display means and a game control means arranged to control images displayed on the display means, the game control means being arranged to play a game wherein at least one random event is caused to be displayed on the display means and, if a predefined winning event occurs, the machine awards a prize, the gaming machine being characterized in that the game is a spinning reel game and, when a special symbol, carried on a reel is displayed on the display means, the special symbol alters a defined set of winning combinations applicable to that game.

The special symbol may determine which combinations of symbols are to be regarded as winning combinations.

The special symbol may be carried on one of the conventional reels of the game in which case the special symbol may substitute for a standard symbol in any winning combination in which the special symbol appears. Instead, the special symbol may appear on a dedicated, separate reel.

According to a second aspect of the invention, there is provided a gaming machine having a display means and a game control means arranged to control images displayed on the display means, the game control means being arranged to play a game wherein at least one random event is caused to be displayed on the display means and, if a predefined winning event occurs, the machine awards a prize, the gaming machine being characterized in that the game is a spinning reel game which includes a standard paytable and at least one further paytable and in that, when a special symbol is carried into a display position by a reel of the game, the special symbol causes one of said further paytables applicable to the game to be used to calculate the prize awarded for a winning combination of symbols.

Prizes for winning combinations of symbols in the at least one further paytable, of which there may be at least two, may vary in a non-uniform manner in comparison with corresponding prizes in the standard paytable.

The further paytables may award prizes that are higher than the corresponding prize in the standard paytable for that particular winning combination of symbols.

In accordance with this aspect also, the special symbol may be carried on one of the conventional reels of the game in which case the special symbol may substitute for a standard symbol in any winning combination in which the special symbol appears. Instead, the special symbol may appear on a dedicated, separate reel.

BRIEF DESCRIPTION OF SEVERAL VIEWS OF THE DRAWINGS

The invention is now described by way of example with reference to the accompanying diagrammatic drawings in which.

DETAILED DESCRIPTION OF THE INVENTION

Figure 1:
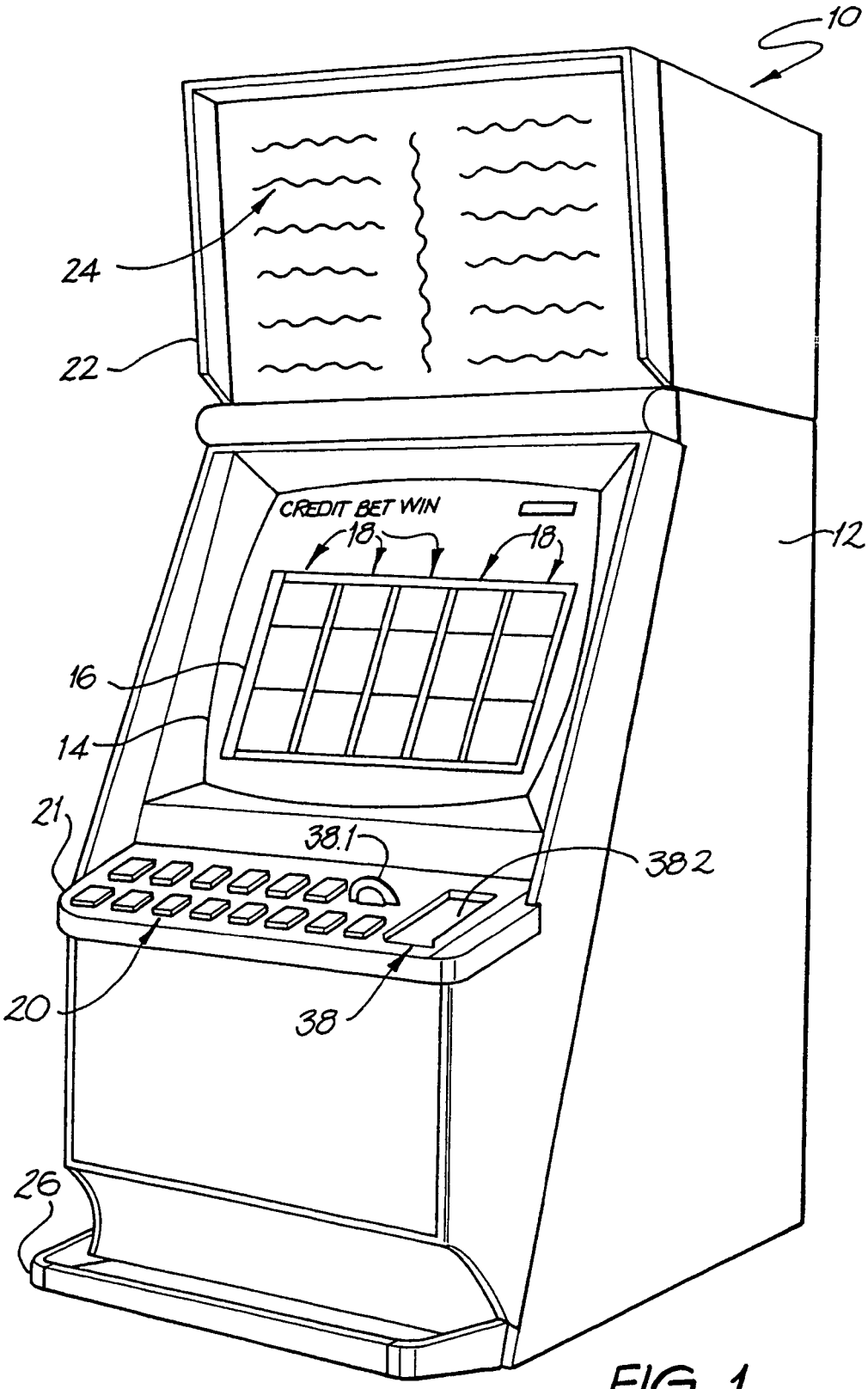
FIG. 1 shows a three dimensional view of a gaming machine, in accordance with the invention.

In FIG. 1, reference numeral 10 generally designates a gaming machine, including a game, in accordance with the invention. The machine 10 includes a console 12 having a video display unit 14 on which a game 16 is played, in use. The preferred form of the game 16 is a spinning reel game which simulates the rotation of a number of spinning reels 18. It will, however, be appreciated that the invention is equally applicable to other types of games such as card games or ball games such as Keno, or the like. A midtrim 20 of the machine 10 houses a bank 21 of buttons for enabling a player to play the game 16. The midtrim 20 also houses a credit input mechanism 38 including a coin input chute 38.1 and a bill collector 38.2.

The machine 10 includes a top box 22 on which artwork 24 is carried. The artwork 24 includes paytables, details of bonus awards, etc.

A coin tray 26 is mounted beneath the console 12 for cash payouts from the machine 10.

Figure 2:
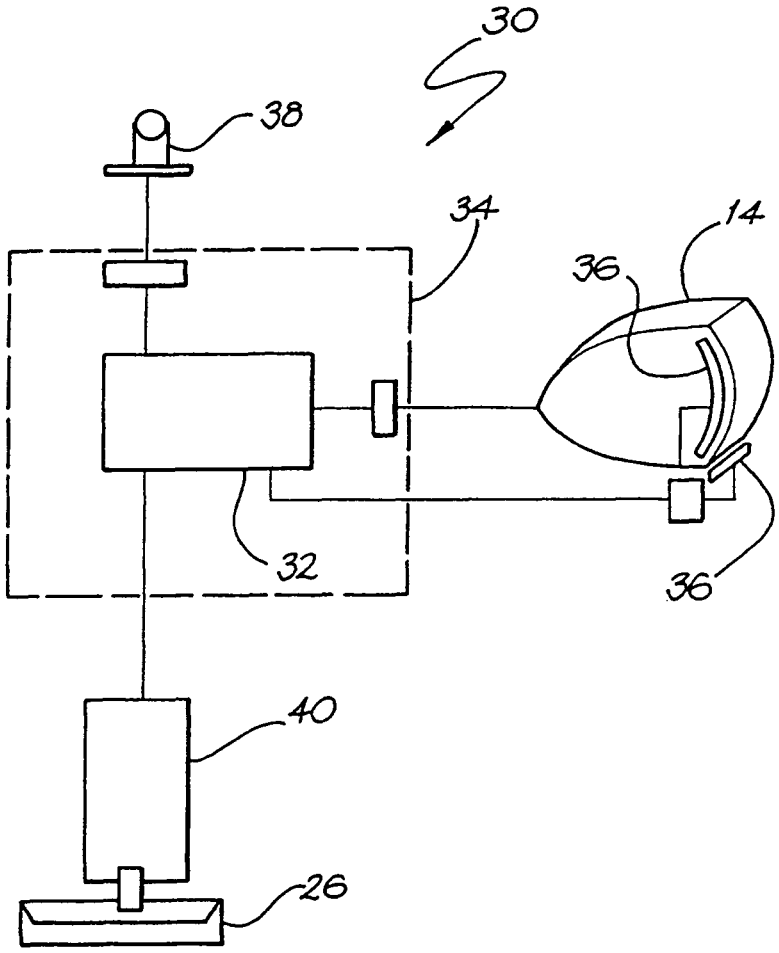
FIG. 2 shows a block diagram of a control circuit of the gaming machine.

Referring now to FIG. 2 of the drawings, a control means or control circuit 30 is illustrated. A program which implements the game and user interface is run on a processor 32 of the control circuit 30. The processor 32 forms part of a controller 34 which drives the screen of the video display unit 14 and which receives input signals from sensors 36. The sensors 36 include sensors associated with the bank 21 of buttons and touch sensors mounted in the screen. The controller 34 also receives input pulses from the mechanism 38 indicating that a player has provided sufficient credit to commence playing. The mechanism 38 may, instead of the coin input chute 38.1 or the bill collector 38.2, or in addition thereto, be a credit card reader (not shown) or any other type of validation device.

Finally, the controller 36 drives a payout mechanism 40 which, for example, may be a coin hopper for feeding coins to the coin tray 30 to make a pay out to a player when the player wishes to redeem his or her credit.

The invention relates to the use of a special symbol in the game where the special symbol performs a particular function. Thus, each symbol of the relevant type performs that function when it appears on the screen. Hence, in the case of a spinning reel game, the special symbols will be carried on the reel strips to be displayed at random intervals.

Figure 3:
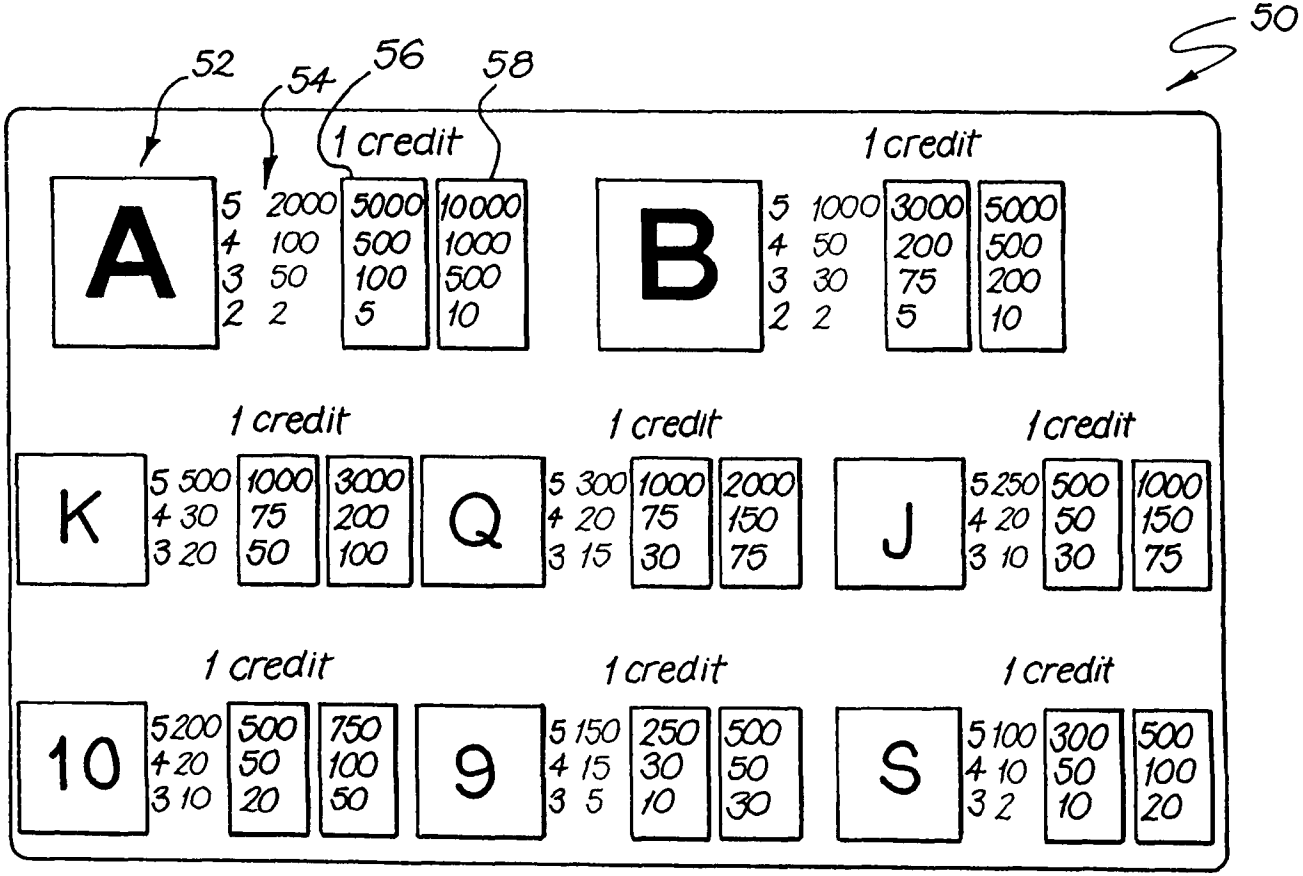
FIG. 3 shows a paytable for a game played on the machine of FIG. 1.

Referring initially to FIG. 3 of the drawings, a paytable is illustrated and is designated generally by the reference numeral 50. It is to be noted that, in respect of each of the standard symbols 52 demarcated on the paytable 50, each symbol 52 has three paytables 54, 56 and 58 associated with it.

Figure 4A:
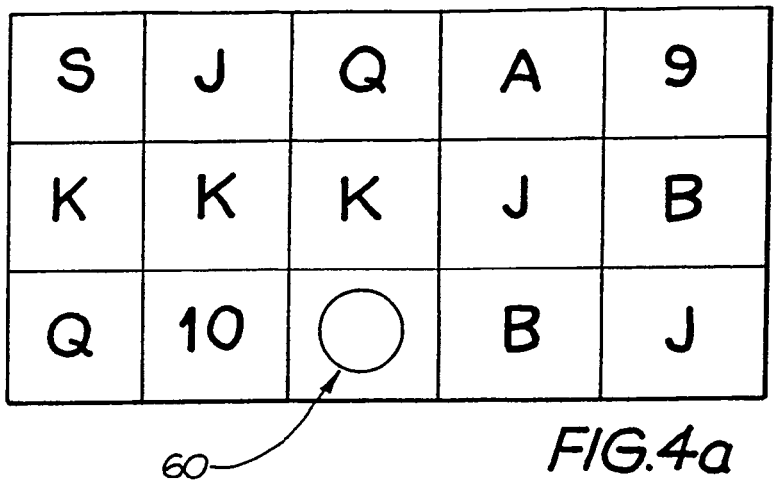
FIGS. 4*a* and 4*b* show screen displays of a first embodiment of the game played on the gaming machine of FIG. 1.
Figure 4B:
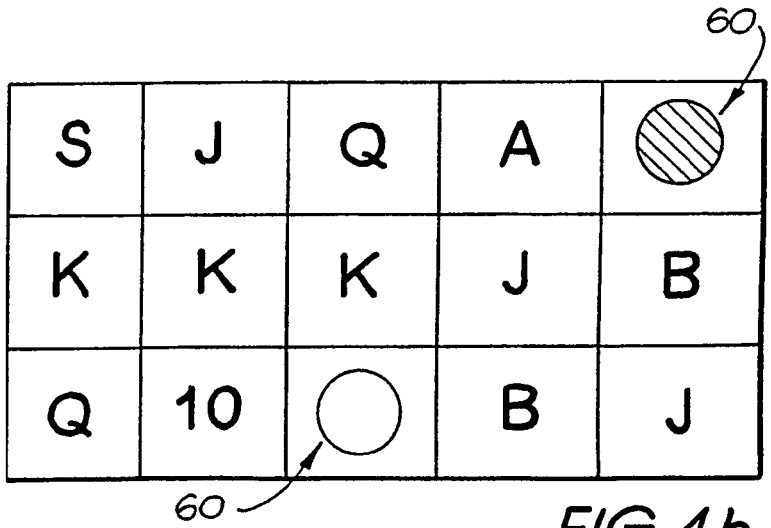

In the embodiment of the invention illustrated in FIGS. 4*a* to 4*b* of the drawings, a special symbol 60 is carried on at least one of the reels 18 of the game 16. In this regard, it is to be noted that the special symbol 60 could, if desired, be carried on a dedicated sixth reel (in respect of a five reel machine) rather than on one of the standard reels 18. The special symbol 60 in accordance with this embodiment of the invention determines the manner in which a current win is paid if a winning result occurs when the reels 18 are spun. Where the special symbol 60 is carried on the standard reel strips, as opposed to a dedicated reel, the special symbol 60 acts as a substitute symbol in addition to its special function.

In the embodiment of the invention illustrated in FIGS. 4*a* and 4*h* of the drawings, it is to be noted that two separate special symbols 60 are provided, each being of a different colour. The special symbols 60 are colour coded to correspond with the paytables 56 and 58 associated with each standard symbol 52 in the paytable 50. The special symbol 60 functions as a win change symbol.

Referring now to FIG. 4*a* of the drawings, a win is awarded for 3×K appearing on payline one. Due to the fact that a grey special symbol 60 also appears, the grey paytable 56 is applicable and fifty credits are paid. Had the special symbol 60 not been present, only twenty credits would have been awarded.

In the example shown in FIG. 4*b* of the drawings, the winning result includes two special symbols 60, a grey special symbol and a black special symbol. The player is awarded one hundred credits from the black paytable 58 associated with the standard K symbol 52. Where two or more special symbols 60 are present, only the highest valued win is paid.

Figure 5:
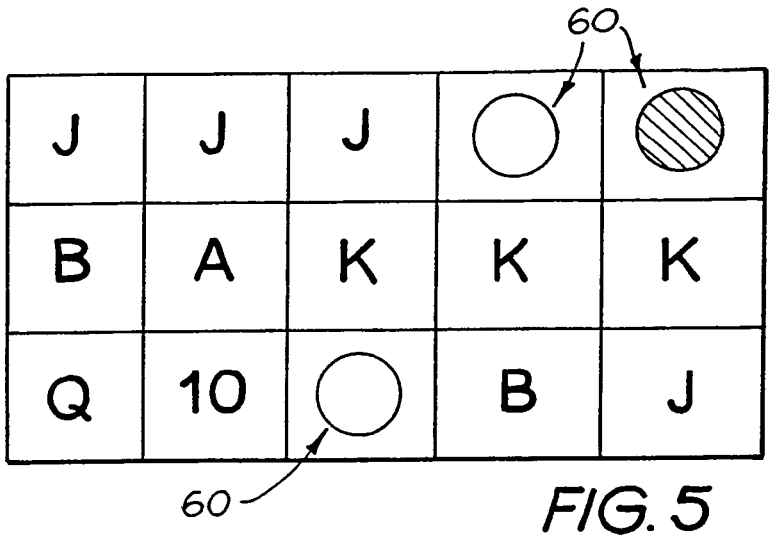
FIG. 5 shows a screen display of a second embodiment of the game.

Referring now to FIG. 5 of the drawings, a different embodiment of the win change special symbol 60 is described. In this case, each special symbol 60 has a specific effect on the way winning combinations will be paid. It is assumed that wins are awarded for combinations occurring on the three standard horizontal paylines.

For example, a standard paytable may be provided where all symbols pay only when appearing in a left-to-right combination on a payline (excluding the scatter feature). In this case, if the grey special symbol 60 appears on the screen, all symbols will pay for a right-to-left combination as well as the left-to-right combination. The black special symbol 60 means that all pays, i.e. the total win, are multiplied by five. The white special symbol 60 substitutes for all standard symbols and any payline win in which such a white symbol 60 substitutes will be multiplied by fifty.

In the embodiment illustrated in FIG. 5 of the drawings, a win will be paid for 3×K because of the appearance of the grey special symbol 60 causing prizes to be paid for right-to left combinations. A further win will be paid for 4×J on payline two due to the white special symbol 60 acting as a substitute symbol. In addition, due to the presence of the white special symbol 60, the win for 4×J on payline two is multiplied by fifty. Finally, due to the presence of the black symbol 60, the total win, i.e. the sum of all the wins, is multiplied by five.

Figure 6A:
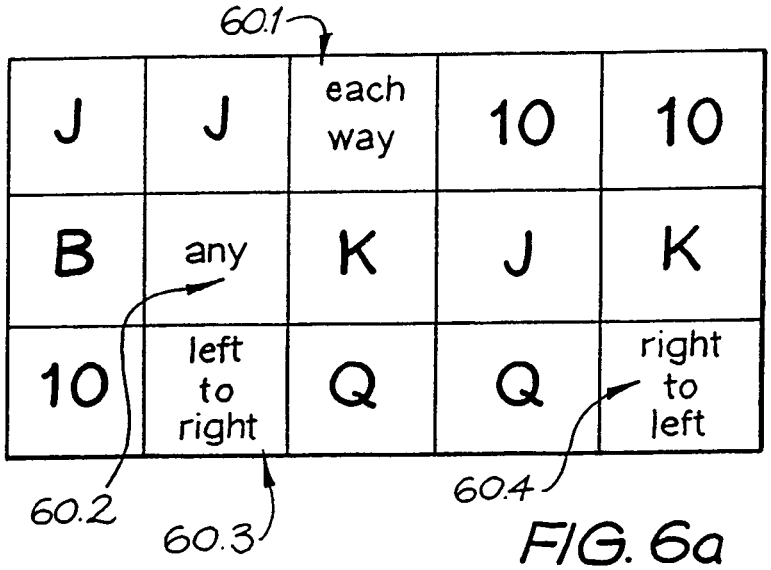
FIGS. 6*a* and 6*b* show screen displays of a third embodiment of the game.

Referring now to FIGS. 6*a* to 5*c* of the drawings, yet a further embodiment of the win change special symbol is described. Once again, for all three examples described below, it is assumed that wins are awarded for combinations occurring on the three standard horizontal paylines.

In this embodiment, more than one special symbol 60 could be provided where each has a different function when substituting in a win. The preferred method is where four different special symbols 60.1 to 60.4 are provided. Special symbol 60.1 substitutes as a symbol in a winning combination for a left-to-right or right-to-left win, hereinafter referred to as an each way win, special symbol 60.2 for an "any" win, special symbol 60.3 for a left-to-right win and special symbol 60.4 for a right-to-left win. Thus, for example, the left-to-right special symbol 60.3 will only substitute in left-to-right winning combinations.

Hence, in the example shown in FIG. 6*a* of the drawings wins would be provided for 2×10 because of "left-to-right" symbol 60.3, 3×Q because of "right-to-left" symbol 60.4, 3×J and 3×10 because of "each way" symbol 60.1 and 3×K, 2×B and 2×J because of the "any" symbol 60.2.

Figure 6B:
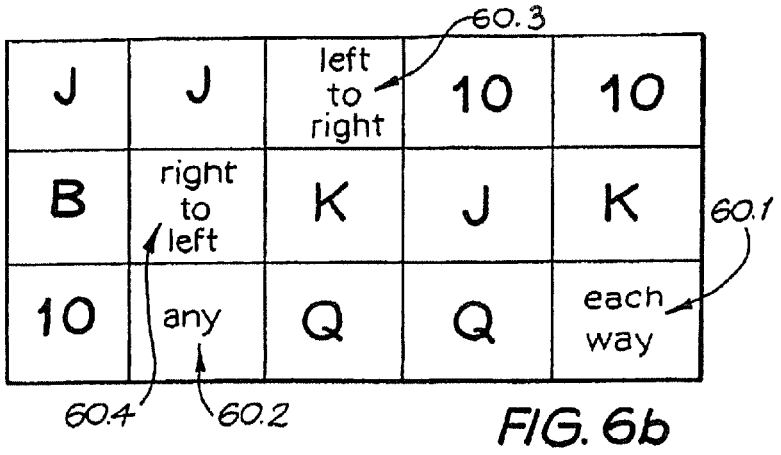

If, however, the special symbols appeared in the combination shown in FIG. 6*b* of the drawings, the result would be the following; 3×J with "left-to-right" 60.3 substituting, 3×Q with "each way" symbol 60.1 substituting and 3×Q and 2×10 with the "any" symbol 60.2 substituting.

Instead, the different functions of the special symbols could be where one functions as a standard substitute on a payline as shown by special symbol 62.1 in FIG. 6*c* of the drawings, another functions as a substitute above or on the payline as shown by special symbol 62.2, yet another symbol 62.3 substitutes below or on the payline for combinations on the payline and yet another symbol 62.4 substitutes on, above or below the payline. It is assumed that the standard three horizontal paylines with a left-to-right paying combination applies.

Figure 6C:
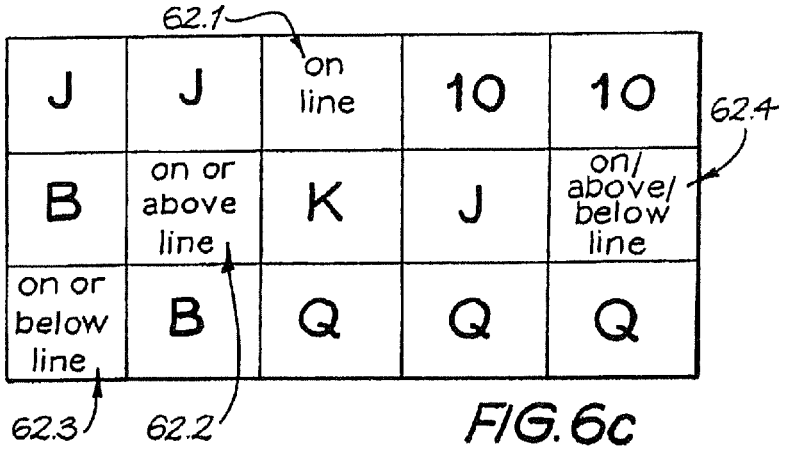
FIG. 6*c* shows a screen display of a fourth embodiment of the game.

In the example shown in FIG. 6*c* of the drawings, assuming only the highest win pays on any payline, prizes are awarded for 3×j on payline two due to special symbol 62.1, 5×Q on payline three due to special symbol 62.3 and 3×K due to special symbols 62.2 and 62.3.

Figure 6D:
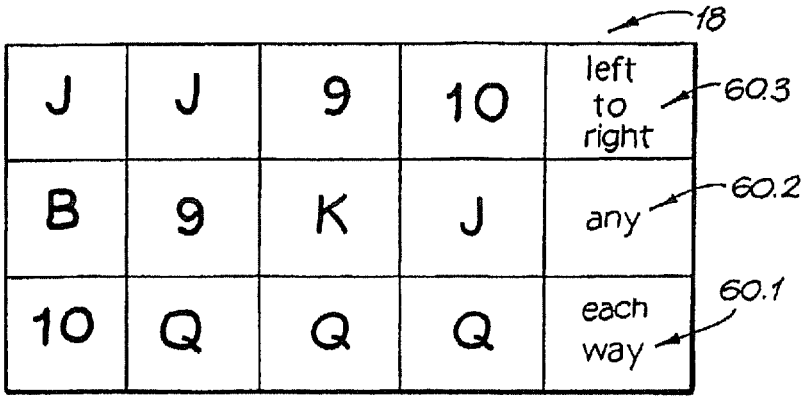
FIG. 6*d* shows a screen display of a fifth embodiment of the game.

In FIG. 6*d* of the drawings, a further version of this embodiment is illustrated. It is assumed in this embodiment that the screen display is for a four reel game. Then, a fifth reel 18 is a dedicated reel carrying the special symbols 60.1 to 60.4 (only symbols 60.1, 60.2 and 60.3 being displayed). The special symbols 60.1 to 60.4 do not serve a substitute function, but only an indicative function. Once again, assuming a three line game, no win is achieved on payline one. If the game pays for two of a kind and because of the presence of the special symbol 60.3, a prize is paid for 2×J on payline two. Due to the presence of the special symbol 60.1, a prize is paid for 3×Q on payline three.

The fifth reel of this version may only spin up or highlight one of the special symbols 60.1 to 60.4 at a time in which case the relevant special symbol will apply to all the active paylines of the game.

Figures 7A, 7B:
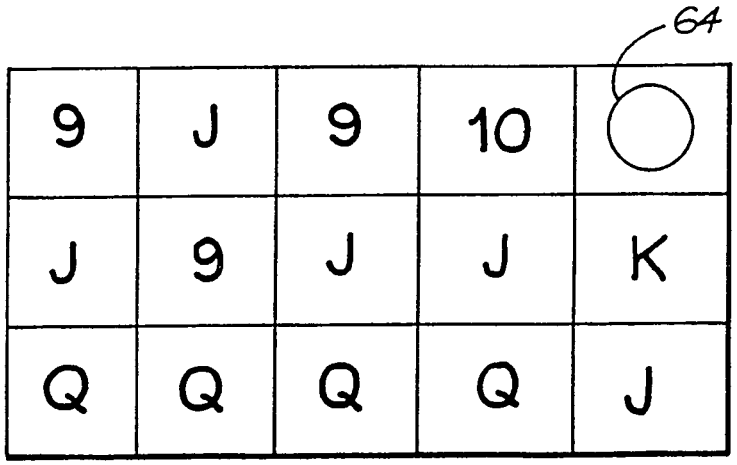
FIGS. 7*a* and 7*b* show screen displays of a sixth embodiment of the game.
Figure 8:
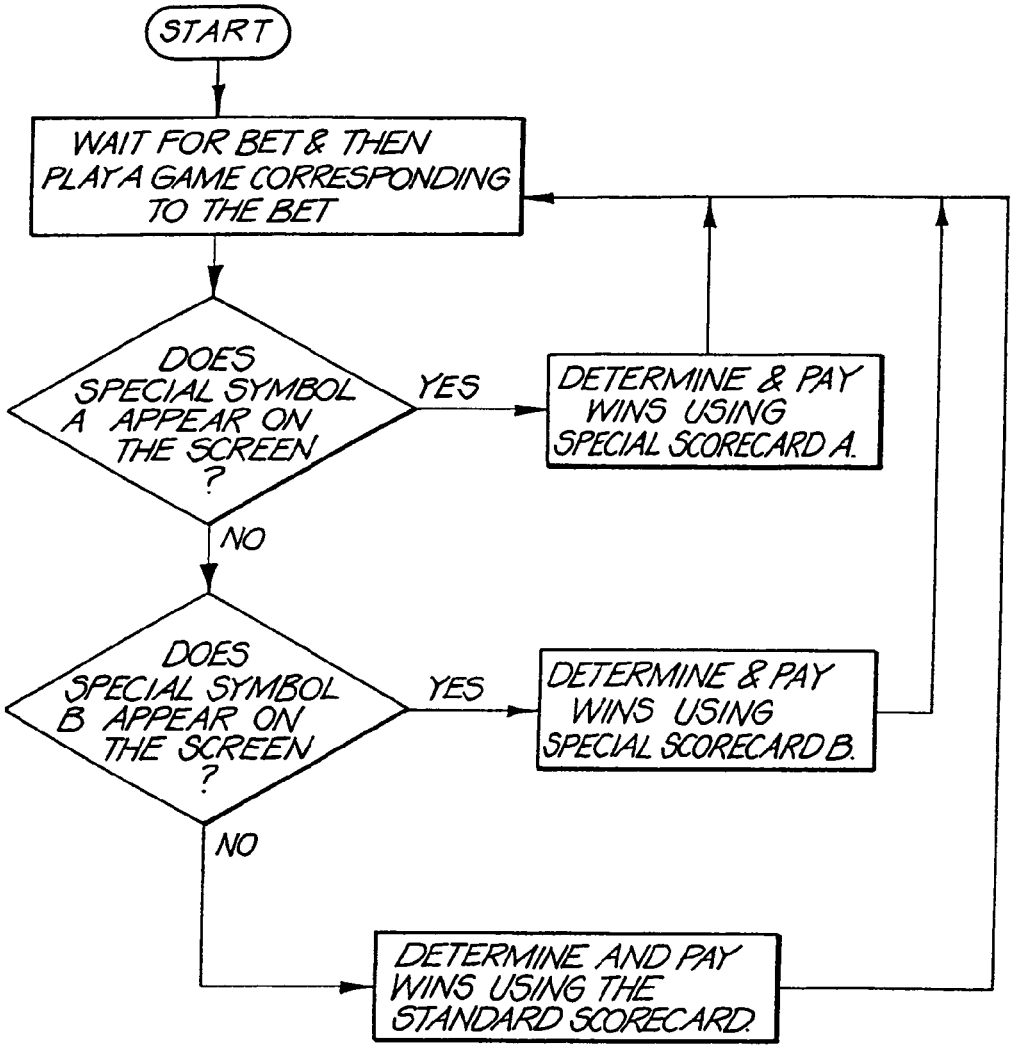
FIG. 8 shows a flow chart of the game described with reference to FIGS. 3 and 4.
Figure 9:
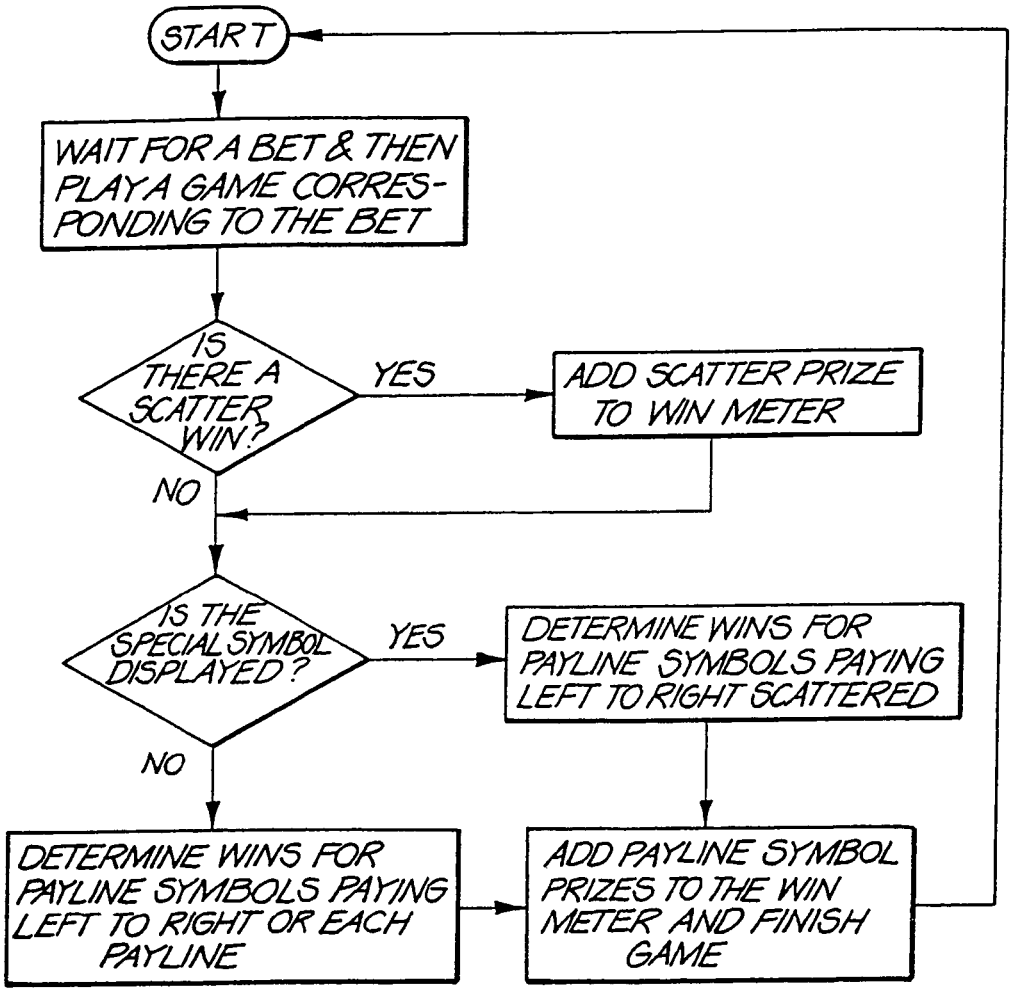
FIG. 9 shows a flow chart of the embodiment of the game of FIG. 7.

Referring to FIGS. 7*a* and 7*b* of the drawings, a further embodiment of the win change special symbol is described. Once again, it is assumed that only the three standard horizontal paylines apply.

In the example illustrated in FIG. 7*a* of the drawings, a prize is awarded only for 4×Q left-to-right on payline 3.

However, when a special symbol 64 is spun up anywhere on the screen, it determines that left-to-right scatter combinations of symbols now pay instead of the symbols having to occur on the paylines. Accordingly, in the example shown in FIG. 7*b* of the drawings, a prize is paid for 5×J, 4×Q and 3×9.

Hence, it is an advantage of the invention that a special symbol is provided which, it is believed, will enhance player interest.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A method of gaming in a gaming machine having an electronic controller and offering a spinning reel game on a plurality of paylines, the gaming machine having a first plurality of reels, each of the first plurality of reels having a plurality of standard symbols and at least one win-change symbol thereon, and a second distinct reel having only a plurality of said win-change symbols thereon, and a paytable, the method comprising:

spinning the first plurality of reels and stopping said first plurality of reels and displaying a random plurality of said symbols on the paylines;

spinning the second distinct reel and stopping said second distinct reel and displaying a random plurality of said win-change symbols;

determining via the electronic controller an outcome from a first of said paylines based on the displayed plurality of said symbols;

determining via the electronic controller that a win-change symbol appears on a second of said paylines;

in response to said determining that a win-change symbol appears on a second of said paylines, determining via the electronic controller a first winning event based on said win-change symbol and said outcome;

determining via the electronic controller a second winning event based on said outcome and said displayed win-change symbols on the distinct reel;

comparing the first and second winning events with respect to the pay-table; and offering an award based on whether the first winning event pays higher than the second winning event according to said pay-table.

2. The method of claim 1, wherein said determining that a win-change symbol appears on a second of said paylines includes determining whether the win-change symbol is of a particular type.

3. The method of claim 1, and further comprising:

determining via the electronic controller that a win-change symbol appears on said first of said paylines;

in response to said determining that a win-change symbol appears on said first of said paylines, determining a third winning event based on said win-change symbol that appears on said first payline and said outcome;

and wherein said comparing includes comparing the first, second, and third winning events with respect to said pay-table; and wherein said offering includes offering an award based on the highest paid of said first, second and third winning event according to said pay-table.

4. The method of claim 1, wherein said determining whether the win-change symbol is of a particular type includes selecting an award from the paytable pay.

* * * * *